US007211177B2

(12) United States Patent
Gestermann et al.

(10) Patent No.: US 7,211,177 B2
(45) Date of Patent: May 1, 2007

(54) ELECTRODE FOR ELECTROLYSIS IN ACIDIC MEDIA

(75) Inventors: Fritz Gestermann, Leverkusen (DE); Hans-Dieter Pinter, Wermelskirchen (DE); Gerd Speer, Burscheid (DE); Peter Fabian, Hanau (DE); Robert Scannel, Pfungstadt (DE)

(73) Assignees: Bayer Aktiengesellschaft, Leverkusen (DE); DeNora Elettrodi S.p.A., Milan (IT)

( * ) Notice: Subject to any disclaimer, the term of this patent is extended or adjusted under 35 U.S.C. 154(b) by 262 days.

(21) Appl. No.: 10/331,999

(22) Filed: Dec. 31, 2002

(65) Prior Publication Data

US 2003/0136669 A1 Jul. 24, 2003

(30) Foreign Application Priority Data

Jan. 3, 2002 (DE) ..... 102 00 072

(51) Int. Cl.
*C25B 11/04* (2006.01)

(52) U.S. Cl. ..... 204/290.14; 204/290.12; 204/290.08; 204/290.09; 204/291; 204/293; 427/419.2; 427/419.7; 427/446; 427/455; 427/450

(58) Field of Classification Search ..... 204/290.01, 204/290.03, 290.06, 290.08, 290.12, 290.14; 427/419.2, 419.7, 446, 455, 450
See application file for complete search history.

(56) References Cited

U.S. PATENT DOCUMENTS

| | | | | |
|---|---|---|---|---|
| 3,880,728 | A * | 4/1975 | Habermann et al. | 205/188 |
| 4,140,813 | A * | 2/1979 | Hund et al. | 427/454 |
| 5,900,127 | A * | 5/1999 | Iida et al. | 204/290.08 |

FOREIGN PATENT DOCUMENTS

| | | |
|---|---|---|
| CH | 665 429 | 5/1988 |
| DE | 23 44 645 | 3/1975 |

* cited by examiner

*Primary Examiner*—Bruce F. Bell
(74) *Attorney, Agent, or Firm*—Connolly Bove Lodge & Hutz LLP

(57) ABSTRACT

Electrode at least comprising an electroconductive support of a titanium-palladium alloy, titanium, tantalum or compounds or alloys of titanium or of tantalum, an electrochemically active coating and an interlayer between the support and the electrochemically active coating, wherein the interlayer consists of titanium carbide and/or titanium boride and is applied to the support by flame or plasma spraying. Process for producing these electrodes and their use in an electrochemical cell for producing chlorine or chromic acid.

17 Claims, No Drawings

ELECTRODE FOR ELECTROLYSIS IN ACIDIC MEDIA

The invention relates to stable electrodes for electrolytic operations, especially for the electrolysis of hydrochloric acid or aqueous solutions of alkali metal dichromate, a process for their production and their use.

Aqueous solutions of hydrogen chloride, hereinafter referred to as hydrochloric acid, are by-produced in many operations, especially in operations where organic hydrocarbon compounds are oxidizingly chlorinated with chlorine. There is a commercial and economic interest in recovering chlorine from these hydrochloric acids and using it for further chlorinations, for example.

Chlorine can be recovered for example electrolytically in an electrochemical cell consisting essentially of an anode space featuring an anode, a cathode space featuring a cathode and an ion exchange membrane separating the two spaces from each other.

The production of chromic acid by electrolysis of sodium dichromate solutions is likewise possible in electrochemical cells having the basic construction mentioned.

A large number of electrodes have been described for electrolytic operations, especially for the electrolysis of hydrochloric acid or of aqueous solutions of sodium dichromate.

DE 29 08 269 A1 describes bipolar carbon-based electrodes which, however, have only a limited service life under the electrolysis conditions. DE 44 17 744 C1discloses carbon-based electrodes where the cathode side is activated by application of noble metal compounds. These electrodes are produced by saturating a graphite body with a solution of the noble metal compound and subsequently heating the saturated graphite body to 200–450° C. using an open gas flame.

U.S. Pat. No. 5,411,641 discloses a process for producing dry halogen by electrolysis of anhydrous hydrogen chloride in an electrochemical cell in which the anode and the cathode are in direct contact with a cation exchange membrane. The anode and the cathode are based on carbon and have a coating of a catalytically active material, for example ruthenium oxide.

U.S. Pat. No. 5,770,035 discloses a process for the electrolysis of an aqueous hydrochloric acid solution by utilizing an anode comprising a corrosion-resistant substrate and an electrochemically active coating. The corrosion-resistant substrate is graphite or else titanium, titanium alloys, niobium or tantalum. The electrochemically active coating used is the result of a standard activation with mixtures of oxides of ruthenium, iridium and titanium. The cathode is described as a carbon-based gas diffusion cathode having a coating of a platinum group metal or a corresponding oxide. The long-term stability of the gas diffusion cathode is low, presumably because loss of contact occurs between the carbon-based gas diffusion electrode and the necessary current distribution electrode which rests on the gas diffusion cathode. A further reason for loss of contact is the formation on the electrodes, during shutdown periods for the electrolytic operation, of oxides which are poor electrical conductors. The formation of such oxides can be prevented by coating the current distributor electrode with a mixed metal oxide which can also be used for the anode coating. However, the mixed metal oxide has poor adhesion to the electrode, so that the long-term stability of the electrode remains unsatisfactory.

The electrodes described are produced by a direct application of the catalytically active layer to a support and have the disadvantage that the service lives of the electrodes under the conditions of electrolysis are not satisfactory.

EP 493 326 A2 describes using electrodes having roughened surfaces to improve the lifetime of these electrodes, specifically by means of rough, plasma-sprayed metallic coatings. The focus is on the production of very rough surfaces.

U.S. Pat. No. 4,392,927 proposes, for the electrolysis of sodium chloride, using composite electrodes consisting of an electroconductive substrate and an electrochemically active cover layer. The electrochemically active cover layer is applied to the substrate by thermal spraying of a powder which contains electrocatalytically active particles as well as matrix particles. The matrix particles are made of titanium oxide, titanium boride and titanium carbide for example as the electrocatalytically active particles of metals of the platinum group or of the iron group or oxides of these metals.

U.S. Pat. No. 4,140,813 discloses a process for producing electrodes having improved long-term stability under the conditions of alkaline chloride electrolysis. A metallic support, preferably of titanium or a titanium alloy, has a first coating of titanium suboxide applied to it by flame or plasma spraying. This is followed by the application of an electrochemically active substance comprising a platinum group element or a compound thereof. Such electrodes exhibit an improved service life under the conditions of sodium dichromate electrolysis. They can even be used when sodium chloride electrolysis is carried out under acidic conditions or when hydrochloric acid is to be electrolysed. However, especially under the strongly acidic conditions of hydrochloric acid electrolysis or alkali metal dichromate electrolysis at a low pH, the service life is not adequate here either.

Testing of anodes having conventional anode coatings has revealed that the active layer will spall off the support after a comparatively short service time. Possible causes include first a fundamental poor level of adhesion between support and active layer and secondly corrosion between the active layer and the metallic support in that corrosion has a deleterious effect on adhesion and this ultimately leads to destruction of the anode coating.

It is accordingly an object of the present invention to develop electrodes having an improved lifetime under the conditions of electrolysis, especially under the strongly acidic conditions of hydrochloric acid electrolysis or an alkali metal dichromate electrolysis conducted in an acidic medium.

It has now been found that, surprisingly, this object is achieved when electrodes are provided with a specific interlayer before the catalytically active layer is applied.

The present invention accordingly provides an electrode at least comprising an electroconductive support of a titanium-palladium alloy, titanium, tantalum or compounds or alloys of titanium or of tantalum, an electrochemically active coating and an interlayer between the support and the electrochemically active coating, wherein the interlayer consists of titanium carbide and/or titanium boride and is applied to the support by flame or plasma spraying.

Compared with the composite electrodes described in U.S. Pat. No. 4,392,927 for sodium chloride electrolysis which contain only one electrochemically active cover layer which comprises electrocatalytically active particles as well as matrix particles, the electrodes according to the invention have increased stability, since the use of an interlayer serves to improve not only the adhesion to the support but also the adhesion of the catalytically active layer.

The electrodes according to the invention are useful as an anode, as a cathode and also as a cathodic current distributor. They exhibit very high stability when used in hydrochloric acid electrolysis or alkali metal dichromate electrolysis in an acidic medium. For instance, these electrodes are extremely stable even when used in the electrolysis of hydrochloric acid having a concentration of <20% by weight of HCl at temperatures of up to 70° C. and high specific current densities of up to 8 kA/m$^2$. Compared with interlayers of titanium oxide or titanium suboxide, the interlayers of titanium carbide and titanium boride are extremely impervious. This prevents any attack of aggressive media, hydrochloric acid say, on the support. In addition, the adhesion of the electrochemically active layer is distinctly improved.

The electrochemically active coating may for example comprise an oxide of an element of the platinum metal group (Ru, Rh, Pd, Os, Ir, Pt).

Preferably, for alkali metal dichromate electrolysis, the electrochemically active layer consists of platinum, iridium dioxide or both or a mixed metal oxide comprising indium dioxide.

The interlayer loading on the support is preferably 10–5000 g/m$^2$.

In a particular embodiment, the interlayer consists of more than one layer, ie the interlayer is applied in a multilayered form by flame or plasma spraying.

The interlayer is preferably a layer of titanium carbide.

The electrodes according to the invention can be produced for example by applying an interlayer to a support and subsequently applying an electrochemically active coating atop the interlayer, wherein the interlayer is applied by flame or plasma spraying using titanium carbide and/or titanium boride powders having different particle sizes, ie having a particle size distribution.

The support used is a net, woven fabric, braided fabric, loop-formingly knitted fabric, nonwoven fabric or foam formed of a titanium-palladium alloy, titanium, tantalum or compounds or alloys of titanium or of tantalum.

The titanium carbide and/or titanium boride powders used for applying the interlayers by flame or plasma spraying preferably have particle sizes of 10 to 200 μm.

As used herein, particle size means the particle diameter as determined by sieve analysis for example.

The flame or plasma spraying is effected in a conventional manner. For example, titanium carbide or titanium boride powder can be applied to the support by means of a commercially available plasma burner. Details concerning plasma spray technology can be taken for example from the "Plasma spray technology, fundamentals and applications 1975" German-language brochure from Plasma-Technik AG. The plasma gas used can be for example a mixture of nitrogen and hydrogen, for example at a volume ratio of nitrogen to hydrogen between 70/30 and 95/5, at a rate of for example 5 to 20 l/min, and the carrier gas used can be nitrogen. The spraying operation can be carried out for example at a current of 200 to 400 A and a voltage of 50 to 90 V. The distance between the plasma burner and the support can be for example 130 to 200 mm.

The electrochemically active coating can be applied in a conventional manner. In one possible procedure, a solution or dispersion of a compound of an element of the platinum metal group (Ru, Rh, Pd, Os, Ir, Pt) and optionally of a compound of titanium is applied atop the interlayer and converted to the corresponding oxides by subsequent thermal treatment. This operation is advantageously repeated a number of times.

The electrodes according to the invention can be used as gas-evolving electrodes for example.

Preference is given to the use of the electrodes in an electrochemical cell for producing chlorine from aqueous hydrochloric acid solutions or chromic acid from a sodium dichromate/chromic acid solution by an oxygen evolution.

The electrochemical cell used may comprise for example an anode space featuring an anode, a cathode space featuring a gas diffusion electrode and a current collector, and a cation exchange membrane separating the anode space and the cathode space from each other, an electrode according to the invention being used as anode, cathode and/or current collector.

The cathode space can have passed into it a gas which consists of or contains oxygen, examples of such a gas being pure oxygen, a mixture of oxygen and inert gases, especially nitrogen, or air, and which preferably is oxygen or an oxygen-rich gas.

The gas which consists of or contains oxygen is advantageously fed at such a rate that oxygen is present superstoichiometrically, based on the amount theoretically required as per equation 1.

$$\begin{array}{rl} \text{Anode reaction:} & 4\ HCl \rightarrow 2Cl_2 + 4H^+ + 4e^- \\ \text{Cathode reaction:} & O_2 + 4H^+ + 4e^- \rightarrow 2H_2O \\ \hline \text{Overall reaction:} & 4\ HCl + O_2 \rightarrow 2Cl_2 + 2H_2O \end{array} \quad (1)$$

When the electrodes are used in an electrochemical cell for producing chlorine from aqueous hydrochloric acid solutions, the aqueous solution of the hydrogen chloride is generally passed into the anode compartment. The temperature of the aqueous hydrogen chloride solution supplied is preferably 30 to 90° C. and more preferably 50 to 70° C.

It is possible to use in particular aqueous solutions of hydrogen chloride having a hydrogen chloride concentration of <20% by weight.

Hydrochloric acid electrolysis is preferably carried out at more than 1 bar absolute and more preferably at 1.05 to 1.4 bar for the pressure in the anode space.

But the electrodes according to the invention are also very useful in an electrochemical cell for producing chromic acid from an aqueous alkali metal dichromate solution, especially from an aqueous sodium dichromate solution. This use is particularly advantageous when the electrolysis of the aqueous sodium dichromate solution is effected under acidic conditions, since conventional electrodes rapidly lose activity in this case.

It is also conceivable to use the electrodes in an electrochemical cell for producing chlorine from aqueous hydrochloric acid solutions as an electric current distributor of a gas diffusion electrode for reducing oxygen.

Embodiments of the process according to the invention will now be more particularly described by way of examples which are not to be understood as limiting the general inventive concept.

EXAMPLE 1

The surface of an expanded metal composed of a standard titanium-palladium alloy (titanium grade 11) was roughened to a roughness depth of 30 to 40 μm by blasting with cast steel grit. The expanded metal was subsequently pickled with 20% by weight hydrochloric acid for about 10 minutes. This also removed the remnants of the blasting abrasive.

The pretreated expanded metal had a layer of titanium carbide applied to it by means of a Plasmatechnik plasma coater. AMPERIT 570.3 plasma powder from H. C. Starck was used. The particle size distribution was determined as −5.6 μm by Microtrac and as +45 by Rotap sieve analysis.

The plasma gas used was helium at a flow rate of 1.3 l/min and nitrogen at a flow rate of 2.5 l/min. The carrier gas used to transport the plasma powder to the burner was nitrogen at 6.5 l/min. The burner output was 560 A at 62 V. The plasma burner inside the soundproof crater was caused to move by an oscillating carriage. The carriage speed was 12 m/min. The horizontal movement was 10 mm per carriage cycle (back and forth). The burner was at a distance of about 150 mm and at an angle of 90°. The titanium carbide layer had a basis weight of 50 to 80 g/m$^2$.

After the expanded metal had been provided with the interlayer it had an electrochemically active layer of $RuO_2$ and $TiO_2$ applied to it. To this end, a mixture of $TiCl_3$ and $RuCl_3$ (molar ratio 1:1) was dissolved in dilute hydrochloric acid (about 2N HCl) and applied to the expanded metal by means of a soft-haired brush. The coated expanded metal was subsequently heated in air at 500° C. This operation was repeated a number of times, preferably 4 to 12 times.

The coated expanded metal was used as an anode and/or cathode net which served as current feeder, ie as current distributor, for an oxygen-consuming cathode.

EXAMPLE 2 (COMPARATIVE)

The surface of an expanded metal composed of a standard titanium-palladium alloy (titanium grade 11) was roughened to a roughness depth of 30 to 40 μm by blasting with cast steel grit. The expanded metal was subsequently pickled with 20% by weight hydrochloric acid for about 10 minutes. This also removed the remnants of the blasting abrasive.

The pretreated expanded metal had an electrochemically active layer of $RuO_2$ and $TiO_2$ applied to it by the method of Example 1.

The coated expanded metal was used as an anode and/or cathode net which served as a current feeder for an oxygen-consuming cathode.

EXAMPLE 3

Electrode Test

An electrochemical cell containing an anode space featuring an anode, a cation exchange membrane and a cathode space featuring an oxygen-consuming cathode and a current collector was fitted with the electrodes described in Examples 1 and 2, each having an active surface area of 100 cm$^2$, as an anode and as a current collector together with the necessary periphery, and tested.

An aqueous hydrochloric acid solution (15–30% by weight) was pumped from a stock reservoir vessel into an anolyte circuit and from there by means of a further pump via a heat exchanger into the anode space of an electrochemical cell. A portion of the depleted hydrochloric acid solution passed together with the chlorine gas evolved at the anode through a line into a column-shaped vessel where a gas-liquid separation took place. A line dipping into the liquid in the column-shaped vessel was used to set a certain pressure in the electrochemical cell and in the anolyte. As a result, the cation exchange membrane was pressed onto the oxygen-consuming cathode which in turn rested on the current distributor.

Oxygen was passed through a line into a vessel which was filled with water and served to humidify the oxygen. The humidified oxygen was fed into the cathode space, was reduced at the oxygen-consuming cathode and reacted with the protons migrating through the cation exchange membrane to form water. Residual oxygen was removed, together with the condensate formed, into a condensate separator. Excess oxygen and the condensate were removed from the electrochemical cell.

The test of the anode was carried out as follows:

An approximately 30% by weight aqueous hydrochloric acid solution was metered into a hydrochloric acid circuit in such a way that the acid concentration in the anolyte circuit and in the cell was about 12–15% by weight of HCl. The temperature of the anolyte solution was set to 60–70° C. The electrolysis was run at a current density of 5 kA/m$^2$. The cation exchange membrane used was a membrane based on a perfluorosulphonate polymer from DuPont (Nafion® 324). The oxygen-consuming cathode used came from E-TEK, was based on carbon and featured a platinum catalyst. The complete cell housing was fabricated from PTFE (polytetrafluoroethylene) and PVDF (polyvinylidene fluoride).

During the electrolytic run, the anode and the current distributor were examined at regular intervals to determine the degree of destruction. The degree of destruction was determined qualitatively by examining the anode and the current distributor under an optical microscope. The degree of destruction was determined quantitatively by using X-ray fluorescence to measure layer thicknesses. The results of the examinations are summarized in Table I (anode) and Table II (current distributor). The degree of destruction is reported as the percentage of the original layer thickness of active coating that has been removed.

TABLE I

| | State of anode coatings: | |
|---|---|---|
| Length of run [days] | Degree of destruction [%] Anode as per Example 1 | Degree of destruction [%] Anode as per Example 2 |
| 50 | 0 | — |
| 100 | <1 | — |
| 200 | ~2 | ~30 |
| 280 | ~5 | ~50 (new activation) |
| 408 | <10 | Run discontinued |

— no determination carried out

TABLE II

| | State of coating on cathode current distributor: | |
|---|---|---|
| Length of run [days] | Degree of destruction [%] Current distributor as per Example 1 | Degree of destruction [%] Current distributor as per Example 2 |
| 50 | 0 | ~2 |
| 100 | 0 | ~3 |
| 200 | 0 | ~10 |
| 280 | <1 | ~20 |
| 408 | <1 | Run discontinued |

The examinations have revealed that, surprisingly, the anode fabricated in Example 1 exhibited an extremely high stability under the abovementioned conditions. The anode potential was still unchanged after a run of 408 days. The comparative test involving an anode fabricated according to Example 2 had to be discontinued after a run of 280 days on account of destruction of the anode coating.

Similarly, the degree of destruction of the current distributor used was distinctly lower with an electrode as per Example 1 according to the invention than with an electrode according to Example 2.

The invention claimed is:

1. An electrode at least comprising an electroconductive support of a titanium-palladium alloy, titanium, tantalum or compounds or alloys of titanium or of tantalum, an electrochemically active coating and an interlayer between the support and the electrochemically active coating, wherein the interlayer consists of titanium carbide and/or titanium boride and is applied to the support by flame or plasma spraying, wherein the electrochemically active coating comprises a mixed metal oxide comprising ruthenium dioxide.

2. Electrode according to claim 1, wherein the interlayer loading on the support is 10–5000 $g/m^2$.

3. Electrode according to claim 2, characterized in that the interlayer is multilayered.

4. Process for producing an electrode as claimed in claim 2 by applying an interlayer to a support and subsequently applying an electrochemically active coating atop the interlayer, characterized in that the interlayer is applied by flame or plasma spraying using titanium carbide and/or titanium boride powders having different particle sizes.

5. Electrode according to claim 1, wherein the interlayer is multilayered.

6. Electrode according to claim 5, wherein the interlayer loading on the support is 10–5000 $g/m^2$.

7. Process for producing an electrode as claimed in claim 6 by applying an interlayer to a support and subsequently applying an electrochemically active coating atop the interlayer, characterized in that the interlayer is applied by flame or plasma spraying using titanium carbide and/or titanium boride powders having different particle sizes.

8. Process for producing an electrode as claimed in claim 5 by applying an interlayer to a support and subsequently applying an electrochemically active coating atop the interlayer, characterized in that the interlayer is applied by flame or plasma spraying using titanium carbide and/or titanium boride powders having different particle sizes.

9. Process for producing an electrode as claimed in 1 by applying an interlayer to a support and subsequently applying an electrochemically active coating atop the interlayer, wherein the interlayer is applied by flame or plasma spraying using titanium carbide and/or titanium boride powders having different particle sizes.

10. Process according to claim 9, wherein the powders used have particle sizes of 10 to 200 μm.

11. An electrode as claimed in claim 1, wherein said interlayer consists of either: (a) titanium carbide and titanium boride; or (b) titanium boride.

12. An electrode comprising an electroconductive support comprising at least one material selected from the group consisting of a titanium-palladium alloy, titanium and tantalum, an electrochemically active coating and an interlayer between the support and the electrochemically active coating, wherein the interlayer comprises, titanium carbide and/or titanium boride, further wherein the electrochemically active coating comprises a mixed metal oxide comprising ruthenium dioxide.

13. An electrode of claim 12 wherein said interlayer consists essentially of said titanium carbide and/or titanium boride.

14. An electrode as claimed in claim 12, wherein said interlayer consists of either: (a) titanium carbide and titanium boride; or (b) titanium boride.

15. An electrode at least comprising an electroconductive support of a titanium-palladium alloy, titanium, tantalum or compounds or alloys of titanium or of tantalum, an electrochemically active coating and an interlayer between the support and the electrochemically active coating, wherein the interlayer consists of titanium carbide and/or titanium boride and is applied to the support by flame or plasma spraying, wherein the electrochemically active coating comprises a mixed metal oxide comprising ruthenium dioxide and titanium dioxide.

16. An electrode as claimed in claim 15, wherein said interlayer is multilayered.

17. An electrode as claimed in claim 15, wherein said interlayer consists of either: (a) titanium carbide and titanium boride; or (b) titanium boride.

* * * * *